United States Patent [19]

Watkins

[11] 4,135,841

[45] Jan. 23, 1979

[54] MUD FLOW HEAVE COMPENSATOR

[75] Inventor: Bruce J. Watkins, Rancho Palos Verdes, Calif.

[73] Assignee: Regan Offshore International, Inc., Torrance, Calif.

[21] Appl. No.: 875,640

[22] Filed: Feb. 6, 1978

[51] Int. Cl.[2] ..... E02B 17/00

[52] U.S. Cl. ..... 405/196; 137/236 S; 166/346; 175/5; 175/7

[58] Field of Search ..... 61/69, 86, 90, 91; 175/7, 5, 25, 65, 48; 92/142, 137; 138/26, 28, 30, 31; 137/236

[56] References Cited

U.S. PATENT DOCUMENTS

| | | | |
|---|---|---|---|
| 3,158,208 | 11/1964 | Kammerer | 175/5 X |
| 3,815,673 | 6/1974 | Bruce et al. | 175/25 X |
| 3,976,148 | 8/1976 | Maus et al. | 175/7 |

*Primary Examiner*—Jacob Shapiro

*Attorney, Agent, or Firm*—Poms, Smith, Lande & Glenny

[57] ABSTRACT

A heave compensator is disclosed particularly adapted for use in compensating the flow through a riser pipe employed in offshore drilling apparatus for surges and ebbs produced in the flow therein by the rising and falling of the surface platform or vessel in relation to the ocean floor. A telescoping section substantially identical to that incorporated within the riser is carried by the floating platform or vessel at a location remote from the telescoping section of the riser. The compensating telescoping section is connected into the flow pipe on one end and closed at the opposite end. The two telescoping sections are disposed normal to the earth's surface whereby gravity tends to extend the compensating telescoping section. The two lower portions of the respective telescoping sections are interconnected by a flexible cable passing over a sheave carried by the platform or vessel. Such interconnection causes the compensating telescoping section to act in an equal and opposite direction to the telescoping actions of the telescoping section within the riser affording a constant compensation for changes in volume.

6 Claims, 7 Drawing Figures

Fig. 1.
PRIOR ART
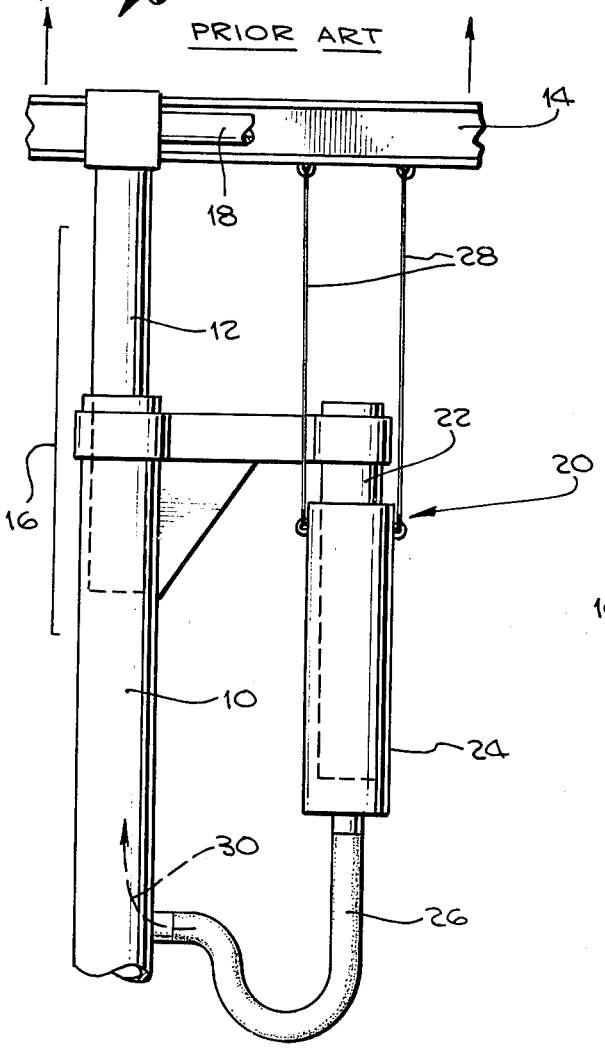
Fig. 2.
PRIOR ART
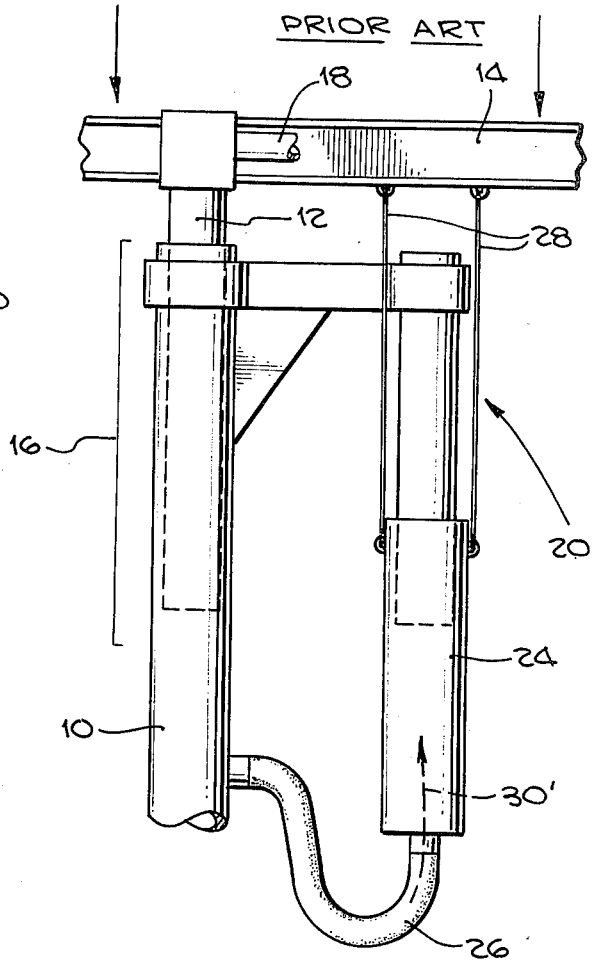
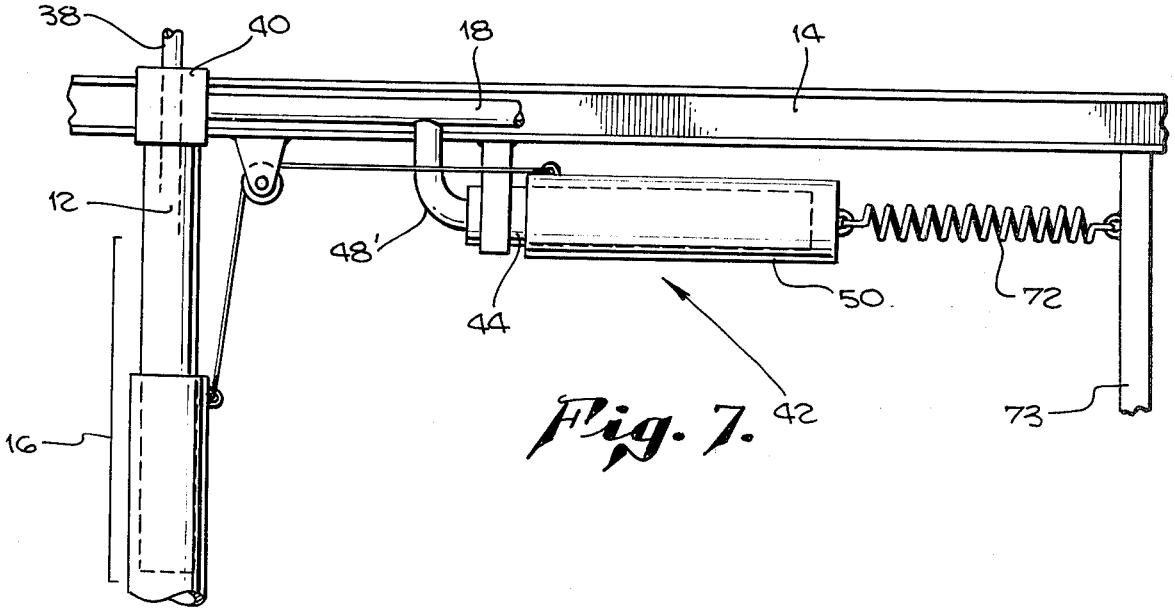
Fig. 7.

MUD FLOW HEAVE COMPENSATOR

BACKGROUND OF THE INVENTION

The present invention relates to offshore drilling apparatus and more particularly to fluid flow measurement apparatus and surge and ebb compensators to be employed therewith.

In most well drilling operations a supply of so-called "drilling mud" is circulated passed the drilling head during the actual drilling operation. The composition of the mud flow rates employed are critical parameters in the drilling operation. Accordingly, it is common practice to incorporate a flow meter in the line wherein the drilling mud is flowing to measure the flow rate of the mud therethrough.

When the drilling operation is at an offshore location, the severity of the environment adds a number of additional consideration into all aspects of the drilling operation. In such operations, a riser pipe extends from the ocean floor where the drill head is located to a floating platform or ship on the surface having the pumping apparatus and the like. The piping carried by the floating platform and the riser pipe attached adjacent the ocean floor are interconnected by a telescoping section which provides for a variable length conduit between the fixed and floating portions. With a "constant" flow of mud through the riser pipe, the flow is subjected to surges and ebbs as the platform rises and falls with the relative position of the water causing the telescoping section to extend and contract respectively. As the telescoping section extends, the total internal volume of the conduit between the ocean floor and the floating platform increases, causing an ebb in the flow of the mud during the transition period. As the platform falls, the telescoping section contracts and the internal volume decreases, causing a temporary surge in the mud flow rate. Such ebbs and surges in the flow rate make the monitoring of the flow rate a difficult task subject to inaccuracies.

Both mechanical and electrical compensators have been proposed as solutions to the problem. Electronic compensators, of course, only approximate or anticipate what compensation factors should be applied. Likewise, electronic compensators are much more delicate and are prone to damage within the rough-and-tumble environment of an offshore drilling rig. A mechanical compensator on the other hand, has inherent qualities of great durability and, as will be seen, by being incorporated directly within the operating fluid flow system, operates directly in combination therewith to compensate for conditions as they actually exist.

One form of mechanical compensator recently developed is shown in FIGS. 1 and 2. The riser pipe 10 extends from the well head (not shown) on the ocean floor to connect to a pipe 12 carried by a floating ship or platform as characterized by the I-beam 14. Riser pipe 10 and pipe 12 are interconnected by a telescoping section 16 which can extend and contract along its longitudinal axis to compensate for changes in length between the ocean floor and the floating platform as the floating platform rises and falls on the ocean's surface. As shown in FIG. 1, the telescoping section 16 is in a substantially extended condition corresponding to the ship rising on the ocean's surface. In FIG. 2, the telescoping section 16 is in a substantially fully contracted position corresponding to a position of the floating platform at maximum fall with respect to the ocean's floor. A process pipe 18 is connected to pipe 12 to conduct the drilling mud in its flow. It is the flow through process pipe 18 which must be monitored for flow rate. It is also the flow-through process pipe 18 which is subjected to ebbs as the telescoping section 16 moves from the position of FIG. 2 towards the position of FIG. 1 and surges as the telescoping section 16 moves from the position of FIG. 1 towards the position of FIG. 2. In the prior art compensating apparatus of FIG. 1 and FIG. 2, a compensating telescoping section generally indicated as 20 is provided. The internal cross-sectional area of compensating telescoping section 20 by necessity, is made identical to that of telescoping section 16. Compensating telescoping section 20 comprises a first or upper portion 22 which is closed on the outer end and is rigidly carried by the fixed portion of telescoping section 16 connected to riser pipe 10. Compensating telescoping section 20 also has a second or sliding portion 24 which is movable longitudinally along the first portion 22. Second portion 24 is connected by a flexible conduit 26 to riser pipe 10. Additionally, second portion 24 is connected (as with cables 28) to the floating platform as represented by I-beam 14. Thus, as the platform rises and falls with relation to the ocean floor, second portion 24 will move in combination therewith. As a result, as telescoping section 16 is extended any distance, compensating telescoping section 20 will be contracted an equal amount. Since the cross-sectional areas of the two are identical, the changes in internal volume of the telescoping sections 16 and 20 will be equal and opposite. Thus, in the extension of telescoping section 16 shown in FIG. 1, additional mud from within telescoping section 20 will flow from flexible conduit 26 into riser pipe 10 (as indicated by the arrow 30) to offset the tendency for an ebb in the flow of the mud therein. In similar manner, in the contraction of telescoping section 16 shown in FIG. 2 as telescoping section 16 contracts, compensating telescoping section 20 will extend causing the potential surge of mud within riser pipe 10 to flow through flexible conduit 26 (as indicated by the arrow 30') into the increasing internal volume of compensating telescoping section 20 to absorb the additional mud flow and, thereby, eliminate the surge within process pipe 18.

As can be seen, the mechanical prior art compensating technique shown in FIG. 1 and FIG. 2 provides workable method for precisely compensating for ebbs and surges within riser pipe 10 caused by the extension and contraction of the telescoping section 16 thereof. As can be surmised from the construction shown in FIG. 1 and FIG. 2, however, the aforementioned prior art technique also poses certain undesirable constraints. For example, since first portion 22 is carried by riser pipe 10 or the fixed portion of telescoping section 16 attached thereto, the two portions must be placed close adjacent one another. This has numerous drawbacks. First, telescoping section 16 may be disposed in an inaccessible spot with relation to the platform or ship. Second, once the compensating telescoping section 20 is operably connected to perform its compensating function, it cannot be quickly and easily removed. Third, it is not easy to install such apparatus on previously installed drilling apparatus or to remove it once it has been installed. Fourth, since the telescoping sections move longitudinally in unison, the internal cross-sectional areas of the two telescoping sections must be identical. Fifth, such apparatus is not easily turned "off" and "on" with respect to accomplishing its compensating function. Last, any flexible connector is a weak link subject to breakage.

Wherefore, it is the object of the present invention to provide a mechanical compensating apparatus for use in combination with undersea drilling operations or similar applications which can be located remote from the telescoping section of the riser pipe, can be easily installed on existing drilling rigs, can be disconnected and reconnected easily at will, is structurally sound, and is not constrained to incorporating a telescoping section substantially identical to that connected in the riser pipe.

SUMMARY

The foregoing objectives have been realized by the apparatus of the present invention applied to offshore drilling apparatus employing a fluid flow conduit having a fixed portion comprising a vertical riser pipe terminating in one segment of a first telescoping section and a floating portion comprising the other segment of the first telescoping section connected to a pipe carried by a floating platform wherein the apparatus of the present invention comprises a second telescoping section closed on both ends, having one segment carried by the floating platform and connected to communicate with the pipe carried by the floating platform, the other segment of the second telescoping section being biased toward its extended position relative to the one segment; a cable connected between the fixed portion of the fluid flow conduit and the other segment of the second telescoping section; and, guide means carried by the floating platform for guiding the cable whereby when the first telescoping section extends in response to the floating platform rising the other segment of the second telescoping section is drawn toward the one segment thereof against the bias by the cable an amount relative to the internal cross-sectional area thereof sufficient to offset the increase in volume of the first telescoping section and whereby when the first telescoping section contracts in response to the floating platform falling, the cable will be slacked off in amount sufficient to allow the bias to extend the second telescoping section an amount relative to the internal cross-sectional area thereof sufficient to offset the decrease in volume of the first telescoping section.

More generally, as applied to a fluid conduit employing a telescoping junction between a first conduit section and a second conduit section, the present invention provides for compensating the fluid flow therein for surges and ebbs produced by longitudinal relative movement between the sections of the conduit through the telescoping junction by apparatus comprising a closed telescoping container having a first part and a second part, the first part being operably connected to move longitudinally along its axis of telescoping in direct combination with longitudinal movement of the first conduit section; a conduit connected to communicate with the fluid conduit on one end and with the container on the other end; and, means connected to the second part and responsive to relative changes in longitudinal position between the first conduit section and second conduit section for moving the second part along its axis of telescoping in the same direction as the first part is moving relative to the second conduit section at a greater rate whereby the internal volume of the container is made to change in the opposite direction an amount equal to any change in internal volume of the fluid conduit as a result of longitudinal movement between the first and second sections thereof.

DESCRIPTION OF THE DRAWINGS

FIG. 1 is a simplified elevation of a mechanical mud flow heave compensator according to the prior art responding to extension of the telescoping section of a riser pipe employed in undersea drilling.

FIG. 2 is a simplified drawing of the apparatus of FIG. 1 showing the apparatus responding to a contraction of the telescoping section of the main riser pipe.

FIG. 7 is a simplified elevation of an alternate embodiment of the apparatus of the present invention.

DESCRIPTION OF THE PREFERRED EMBODIMENT

Figure 3:
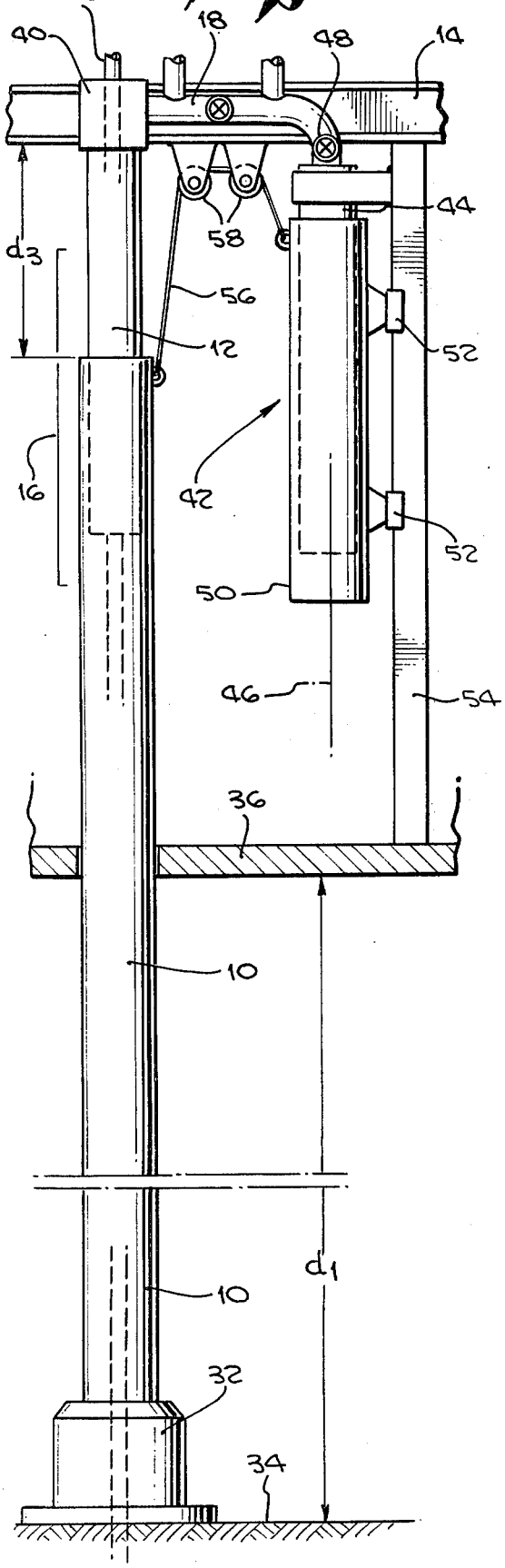
FIG. 3 is a simplified elevation drawing of the apparatus of the present invention as employed in undersea drilling operations responding to extension of the telescoping section of the riser pipe.
Figure 4:
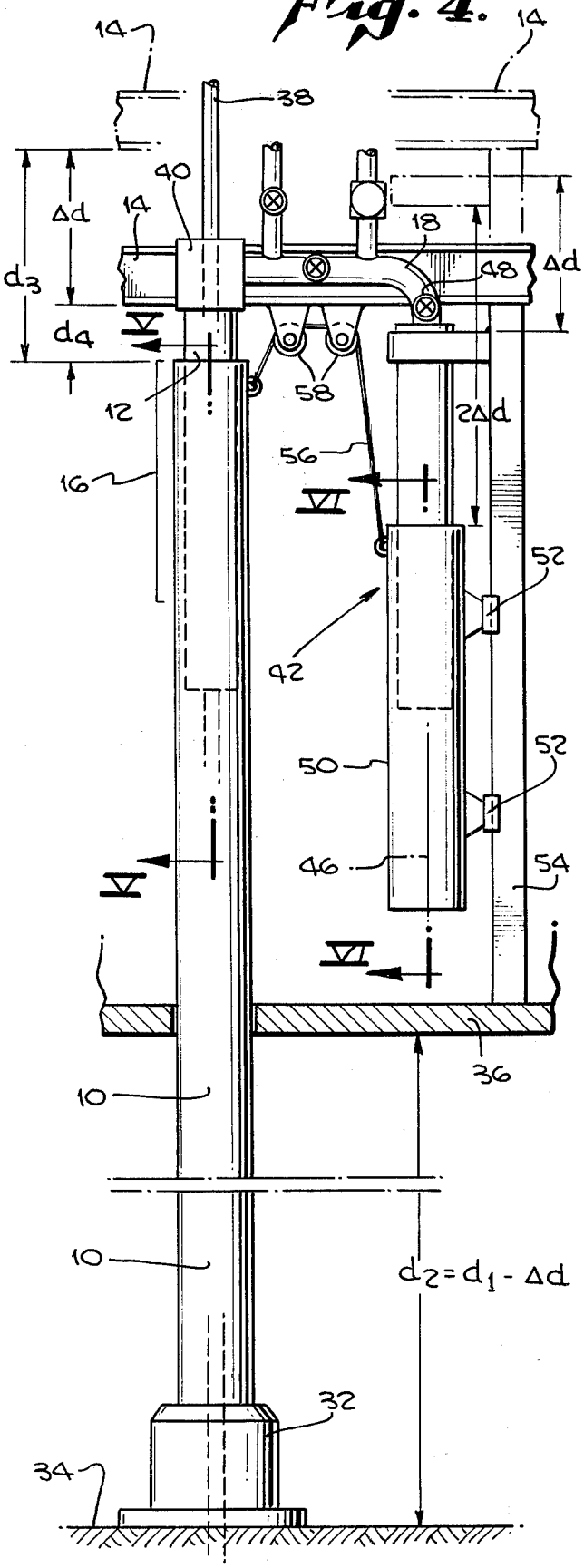
FIG. 4 is a simplified drawing of the apparatus of FIG. 3 showing the apparatus responding to a contraction of the telescoping section of the riser pipe.

Referring first to FIGS. 3 and 4, the apparatus of the present invention is shown in simplified form. It is to be understood that the components shown are representative only and are not intended to be to scale. Thus, where the telescoping section in the main riser pipe to be described hereinafter is shown as being located within the hull of the vessel or floating platform, it could be as well disposed below the hull of the vessel with a passageway passing through the hull of the vessel for the cable which attaches thereto. Likewise, while the description of the apparatus of the present invention relative to its preferred embodiment is shown with reference to undersea drilling apparatus, it is to be understood that the principle could equally as well be applied to other fluid flow conduits having a telescoping section therein moving in oscillatory fashion requiring compensation for ebbs and flows in the internal fluid carried thereby.

The environment described with reference to FIG. 1 and FIG. 2 is substantially identical. That is, a riser pipe 10 extends from a well head 32 located on the ocean floor 34. Riser pipe 10 is connected to a pipe 12 which in turn is connected to a process pipe 18 through a telescoping section 16. Process pipe 18 is carried by a floating platform or ship as characterized by the I-beam 14 and hull 36. The drill pipe 38 passes through a packing gland 40 down through the riser pipe 10 to the well head 32.

In the present invention, a telescoping container 42 is carried by the floating platform to perform the compensating functions. While, for purposes of the drawings, the telescoping container 42 is shown close adjacent telescoping section 16, it will be understood that because in the preferred embodiment the two are interconnected by a cable in a manner to be described hereinafter, telescoping container 42 could be disposed at a considerable distance from telescoping section 16. Telescoping container 42 can conveniently be a riser pipe telescoping section, such as telescoping section 16, closed at the ends thereof. In the preferred embodiment, it is convenient to use a telescoping section identical to the telescoping section 16 employed in the riser pipe 10. Because of the nature of the present invention, it is not, however, necessary to do so, only more convenient.

The first or fixed portion 44 of telescoping container 42 is carried to move in combination with pipe 12 along a vertical axis 46 parallel to the common longitudinal axis of riser pipe 10 and pipe 12. It is convenient to accomplish this by rigidly connecting first portion 44 to process pipe 18 by a rigid conduit 48. The second or moving portion 50 of telescoping container 42 is fitted with guide means 52 adapted to travel along a track 54 disposed between I-beam 14 and hull 36 whereby second portion 50 is guided to move longitudinally along common axis 46 with reference to first portion 44.

Riser pipe 10 and second portion 50 preferably are interconnected with a cable 56 passing over a pair of sheaves 58. The cable 56 rises vertically from riser pipe 10 (in the area adjacent telescoping section 16) to the first sheave 58. The sheaves 58 are disposed to have their axes of rotation normal to the longitudinal axis of riser pipe 10 and axis 46. Thus, as cable 56 passes over first sheave 58 it is guided in a horizontal direction toward the second sheave 58. It can be seen therefore, that the two sheaves 58 can be disposed at horizontally extended distances whereby telescoping container 42 can be disposed at an extended distance from telescoping section 16 as hereinbefore mentioned. After passing over second sheave 58, cable 56 is deflected in a substantially vertical downward direction towards second portion 50 of telescoping container 42. Thus, contrary to the prior art technique of FIG. 1 and FIG. 2, the rigid or fixed portion of the compensating apparatus is carried by the floating platform rather than by the riser pipe 10. Even in its basic form as heretofore described with reference to FIG. 3 and FIG. 4, this approach provides significant advantages over the prior art. It provides additional capabilities, however, to be described hereinafter.

The action of the compensating apparatus of the present invention in response to the ship falling with respect to the ocean floor is shown in FIG. 3 and FIG. 4. FIG. 3 corresponds to the initial position of the vessel, riser, and compensating apparatus. FIG. 4 corresponds to the position of the vessel, riser, and compensating apparatus following a decrease in distance d with respect to the ocean floor. As can be seen with particular reference to FIG. 4, the hull 36 of the ship has changed from a distance $d_1$ to a distance $d_2$ from the ocean floor 34, where $d_2$ is equal to $d_1 - d$. In so doing, the distance from the top of the fixed portion of telescoping section 16 to the bottom of the I-beam 14 has changed from a distance $d_3$ to a distance $d_4$, where $d_4$ is equal to $d_3 - d$. Both the foregoing changes in distance have been affected by a moving body moving relative to a fixed body. The compensation of the compensating apparatus of the present invention in its preferred embodiment is caused by two moving bodies moving simultaneously in the same direction at different rates.

As will be recognized, the two sheaves 58 in combination with the cable 56 as connected in FIGS. 3 and 4 provide a motion multiplying device giving a 2:1 mechanical advantage. As with any "block and tackle", the 2:1 mechanical advantage can only be gained at a ocrresponding loss of distance. Consequently, for every unit of distance that the sheaves move vertically in one direction, second portion 50 will move two units in the same direction. Thus, as I-beam 14 moves a distance downward of d between the position of FIG. 3 and FIG. 4, first portion 44 carried in combination therewith will move vertically along axis 46 downward a distance d in combination therewith. Simultaneously, however, second portion 50 will move downward a distance 2 d (because of the mechanical advantage previously discussed). The total effect on telescoping container 42 of the simultaneous movements of first portion 44 and second portion 50 at various rates as just described, will be an extension of telescoping container 42 a distance of d ($2d - d = d$) which exactly offsets the contraction of telescoping section 16 by the identical distance d. As will be understood, where the present invention incorporates cable 56 and sheaves 58 as a multiplying means connecting vertical riser 10 to second portion 50 with a 2:1 mechanical advantage whereby a telescoping section identical to telescoping section 16 can be incorporated to advantage as telescoping container 42, bu substituting a different mechanical advantage between vertical riser 10 and second portion 50, a different internal cross-sectional area apparatus could be employed as telescoping container 42.

Figure 5:
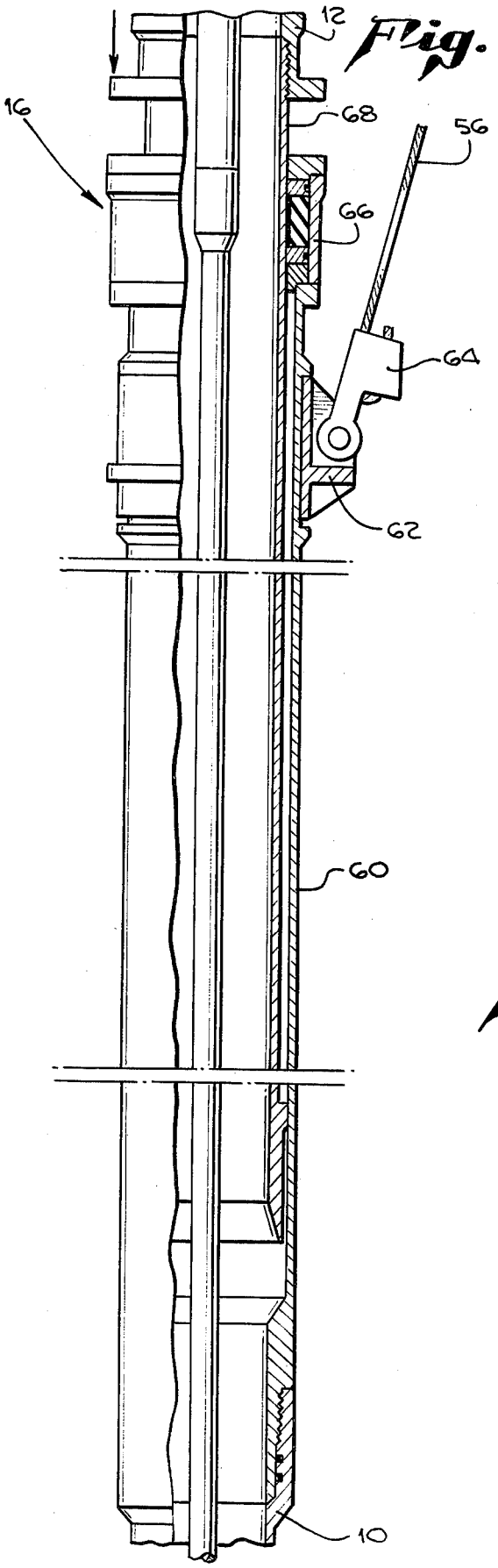
FIG. 5 is a partially cut-away more detailed sectional drawing of the riser pipe telescoping section of FIG. 4 in the plane V—V.
Figure 6:
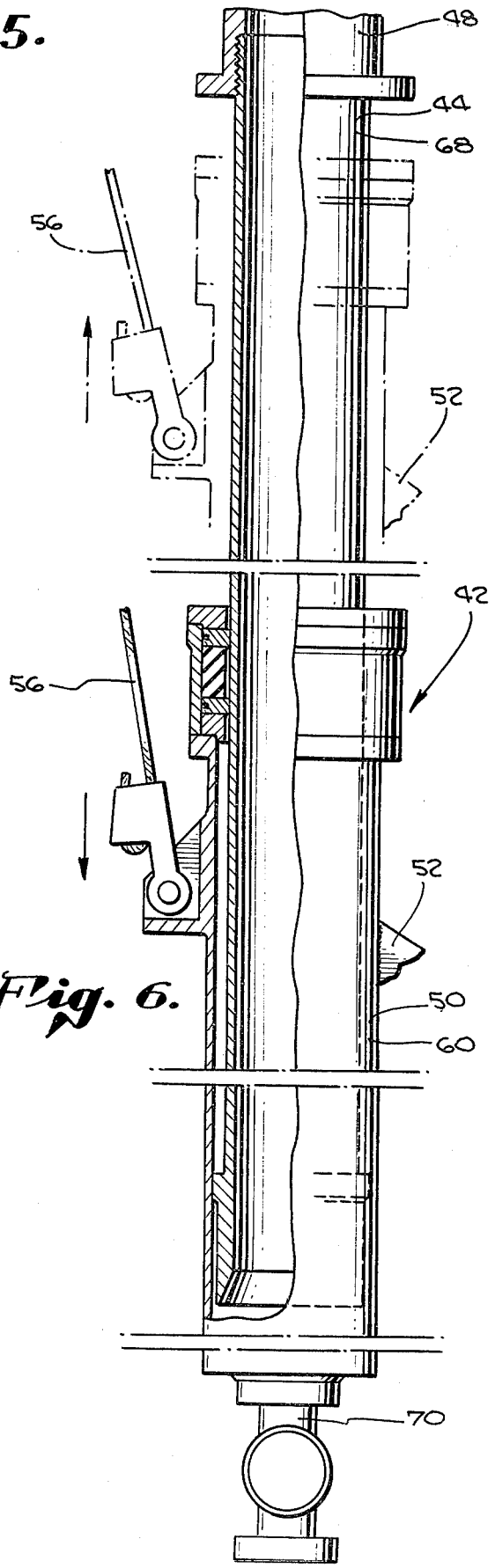
FIG. 6 is a partially cut-away more detailed view of the telescoping section of the apparatus of FIG. 4 in the plane VI—VI.

Turning briefly to FIGS. 5 and 6, the telescoping sections and preferred manner of interconnecting them by means of a cable are shown in greater detail. As can be seen, the telescoping section generally shown as 16 comprises an external portion 60 having a bracket 62 adapted for pivotal connection to a cable connector 64. The upper end of external portion 60 is provided with a packing gland 66. An internal portion 68 passes through packing gland 66 to move longitudinally within external portion 60 with leakage being prevented by packing gland 66. The outward ends of external portion 60 and internal portion 68 are threaded for engagement with riser pipe 10 and pipe 12 respectively as shown. The only change necessary to such a typical telescoping section employed in a marine riser pipe to practice the present invention is the addition of the bracket 62. A telescoping section thus adapted by the addition of bracket 62 can be conveniently employed in the embodiment of the present invention shown in FIGS. 3 and 4 (wherein a 2:1 mechanical ratio is employed) for both telescoping section 16 and telescoping container 42. If such is the case, the first portion 44 corresponds to the internal portion 68 and is connected to the rigid conduit 48 as shown in FIG. 6. In similar manner, the second portion 50 corresponds to the external portion 60 having guide means 52 attached thereto and being closed at the opposite end. Closure of the bottom is conveniently provided by a valve 70 adapted for threaded engagement with the end of external portion 60 (second portion 50) as shown in FIG. 6. Valve 70 thus allows any mud contained within container 42 to be purged and provides a passage for the ingress and egress of air and fluids during assembly or disassembly thereof.

As can be seen from FIGS. 3 and 4, the second portion 50 of telescoping container 42 is biased towards its extended position by the force of gravity because of its vertical orientation. Thus, cable 56 must pull second portion 50 vertically along first portion 44 against the bias of gravity but need only provide slack for movement in the opposite direction whereby second portion 50 is extended by the bias force of gravity. The previously stated objective of making the compensating apparatus easily deactivatable is easily provided therefore, by providing means for holding second portion 50 in its maximum vertical position. This can be accomplished easily by concentric holes passing through guide means 52 and track 54 through which a pin (not shown) can be inserted.

Turning briefly to FIG. 7, an alternate embodiment of the present invention is shown which may find use in other applications. In the apparatus of FIG. 7, the basic components are substantially the same, with the exception that the telescoping container 42 is oriented in a horizontal position. This 90° rotation of container 42 has a number of significant effects. First, the force of gravity no longer tends to extend second portion 50 with relationship to first portion 44. Thus, an external extending bias force must be applied to external portion 50 (such as provided by the spring 72 connected to the beam 73 shown). Second, the single change in direction from vertical to horizontal accomplished by the single sheave 58 with respect to cable 50 provides only a 1:1 mechanical advantage. At the same time, however, first portion 44 and second portion 50 no longer move simultaneously vertically. Thus, a vertical extension of telescoping section 16 a distance d will cause second portion 50 to be contracted along first portion 22 against the bias of spring 72 the same distance d to effect the desired volume change compensation offset. As with the preferred embodiment previously described, a different mechanical advantage can be implemented between riser 10 and its connection to second portion 50 employing cable and sheaves as preferred or employing mechanical linkages or the like whereby different cross-sectional area telescoping containers can be used for the container 42.

Thus, it can be seen that the foregoing invention in both its preferred and alternate embodiment has accomplished the objectives set forth earlier by providing a mechanical compensator for use in conjunction with telescoping conduits which can be located remote from the telescoping conduit, easily installed to work with existing installations, and easily deactivated when compensation is not desired.

Wherefore, having thus described my invention, I claim:

1. In a fluid conduit employing a telescoping junction between a first conduit section and a second conduit section, the improvmement for compensating the fluid flow therein for surges and ebbs produced by longitudinal relative movement between the sections of the conduit through the telescoping junction comprising:

(a) a closed telescoping container having a first part and a second part, said first part being operably connected to move longitudinally along its axis of telescoping in direct combination with longitudinal movement of the first conduit section;

(b) a conduit connected to communicate with the fluid conduit on one end and with said container on the other end; and, (c) means connected to said second part and responsive to relative changes in longitudinal position between the first conduit section and the second conduit section for moving said second part along its axis of telescoping in the same direction as said first part is moving relative to the second conduit section at a greater rate whereby the internal volume of said container is made to change in the opposite direction an amount equal to any change in internal volume of the fluid conduit as a result of longitudinal movement between the first and second sections thereof.

2. The fluid flow compensating apparatus claimed in claim 1 wherein said means for moving said second part comprises:

(a) a sheave operably connected to move in direct combination with said first part and the first conduit section, said sheave being disposed with its axis of rotation normal to the longitudinal axis of the fluid conduit; and, (b) a non-stretchable flexible connector passing over said sheave being connected to said second part on one end and to the second conduit section on the other end whereby said second part is caused to move in the direction of movement of said first part relative to the second conduit section at twice the rate thereof.

3. In offshore drilling apparatus employing a fluid flow conduit having a fixed portion comprising a vertical riser pipe terminating in one segment of a first telescoping section and a floating portion comprising the other segment of the first telescoping section connected to a pipe carried by a floating platform, apparatus for maintaining the total internal volume of the fluid flow conduit constant as the first telescoping section extends and contracts in response to the floating platform rising and falling relative to the ocean floor, said apparatus comprising:

(a) a second telescoping section closed on both ends, having one segment carried by the floating platform and connected to communicate with the pipe carried by the floating platform, the other segment of said second telescoping section being biased toward its extended position relative to said one segment;

(b) a cable connected between the fixed portion of the fluid flow conduit and said other segment of said second telescoping section; and, (c) guide means carried by the floating platform for guiding said cable whereby when the first telescoping section extends in response to the floating platform rising said other segment of said second telescoping section is drawn toward said one segment thereof against said bias by said cable an amount relative to the internal cross-sectional area thereof sufficient to offset the increase in volume of the first telescoping section and whereby when the first telescoping section contracts in response to the floating platform falling said cable will be slacked off an amount sufficient to allow said bias to extend said second telescoping section an amount relative to the internal cross-sectional area thereof sufficient to offset the decrease in volume of the first telescoping section.

4. The compensation apparatus claimed in claim 3 wherein:

(a) said second telescoping section is of equal internal cross-sectional area to the first telescoping section disposed vertically with the upper segment being said one segment carried by the floating platform whereby said bias is provided by gravity acting on said other segment thereof; and, (b) said guide means comprises at least one sheave having a horizontal axis of rotation over which said cable passes whereby when the floating platform rises a distance D relative to the ocean floor causing the first telescoping section to increase in volume by a volume V said one segment of said second telescoping section will rise the same distance D and said other segment of said second telescoping section will be raised by said cable a distance of 2D to thereby decrease the volume of the second telescoping section by the same volume V.

5. The compensation apparatus claimed in claim 4 wherein:

said guide means includes at least two sheaves having parallel horizontal axes of rotation whereby said cable can be guided horizontally therebtween so that said second telescoping section can be horizontally remotely located from the first telescoping section.

6. The compensation apparatus claimed in claim 3 and additionally comprising:

means operably connected to said other segment for guiding said other segment longitudinally along said one segment.

* * * * *